United States Patent [19]

Edwards et al.

[11] Patent Number: 4,550,775

[45] Date of Patent: Nov. 5, 1985

[54] COMPRESSOR INTERCOOLER

[75] Inventors: John C. Edwards, Onalaska, Wis.; Russell A. Ford, Winona, Minn.

[73] Assignee: American Standard Inc., New York, N.Y.

[21] Appl. No.: 544,028

[22] Filed: Oct. 21, 1983

[51] Int. Cl.[4] ..... F28B 9/00; F28F 9/22

[52] U.S. Cl. ..... 165/111; 165/114; 165/145; 165/160; 165/913

[58] Field of Search ..... 165/145, 139, 47, 143, 165/111, 144, 157, 158, 159, 160, 110, 112, 113, 114, DIG. 18; 415/179

[56] References Cited

U.S. PATENT DOCUMENTS

| | | | |
|---|---|---|---|
| 1,796,510 | 3/1931 | Delas | 165/145 |
| 1,917,595 | 7/1933 | McDermet | 165/114 |
| 2,856,161 | 10/1958 | Flynn | 165/129 |
| 2,869,833 | 1/1959 | Aronson et al. | 165/145 |
| 3,351,131 | 11/1967 | Berthold | 165/159 |
| 4,031,953 | 6/1977 | Kline | 165/143 |
| 4,134,450 | 1/1979 | Boyer et al. | 165/111 |
| 4,193,446 | 3/1980 | Greis et al. | 165/114 X |
| 4,201,191 | 5/1980 | Zink et al. | 165/111 |
| 4,252,186 | 2/1981 | Starner et al. | 165/114 |

FOREIGN PATENT DOCUMENTS

| | | | |
|---|---|---|---|
| 2105657 | 6/1979 | Fed. Rep. of Germany | 165/145 |

*Primary Examiner*—Sheldon J. Richter

*Attorney, Agent, or Firm*—Ronald M. Anderson; Carl M. Lewis; William J. Beres

[57] ABSTRACT

A heat exchanger of the shell and tube type particularly suitable as an intercooler between compression stages of a compressor is disclosed. The heat exchanger includes a generally cylindrical shell having first and second coil banks disposed therein. The banks are spaced from each other and from the wall of the shell. The incoming fluid flows between the heat exchange coil banks and outwardly therethrough, passing in heat exchange relationship with a fluid flowing through the coils. The fluid velocity is reduced, substantially minimizing carryover of liquid in the fluid, and directional changes in the fluid flow causes disentrainment of liquid. A sump is provided in the bottom of the heat exchanger for removing the condensed liquids, and separate demistors or separators are not required. Access to the coils for cleaning and/or servicing may be had through a manway disposed in the shell, or through an openable end of the shell.

11 Claims, 4 Drawing Figures

FIG. 1
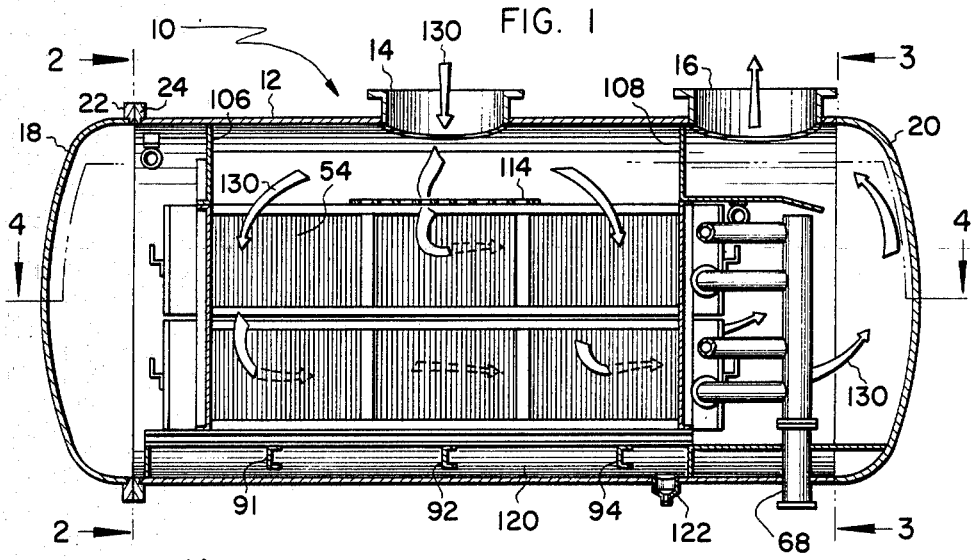
FIG. 2
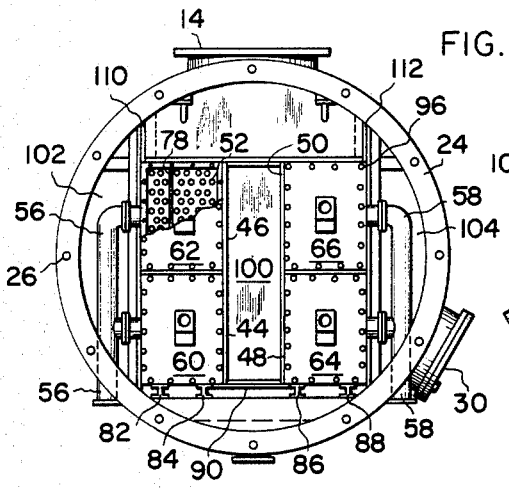
FIG. 3
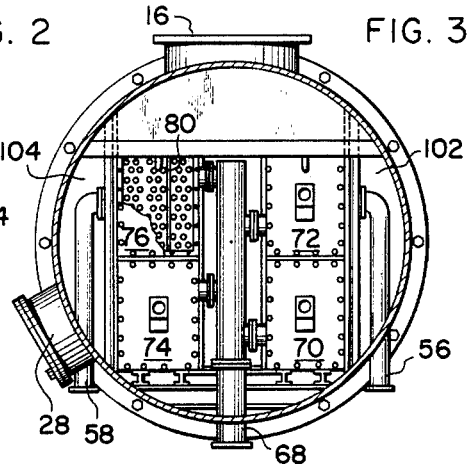
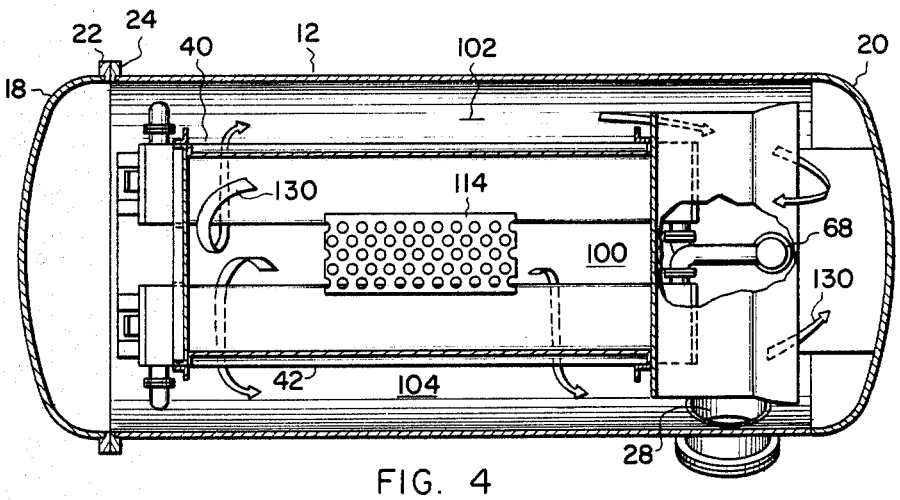
FIG. 4

COMPRESSOR INTERCOOLER

BACKGROUND OF THE INVENTION

1. Technical Field

This invention pertains broadly to the field of heat exchangers, and more specifically to arrangements of components in large intercoolers or aftercoolers.

2. Prior Art

Large compressors often use heat exchangers as aftercoolers or as intercoolers between compression stages. The horsepower required for achieving the desired final pressure is related to the temperature and pressure of the fluid being compressed. The horsepower required increases if the temperature increases or the pressure decreases at any compression stage inlet. An intercooler should, therefore, effect a significant temperature change at minimal pressure loss. Typically, the heat exchangers have shells with inlets and outlets for the process fluid and have heat transfer surfaces such as tube bundles or finned tube coils within the shells through which the conditioning fluid flows. The process fluid flows from the inlet in the shell along the heat transfer surfaces in heat exchange relationship with the conditioning fluid and flows out through the outlet of the shell. In many such systems, large quantities of condensate are formed as the process fluid is cooled, and, due to high fluid velocities, much of the condensate becomes entrained in the fluid flow. Disentrainment of liquids can be a problem in intercooler systems of compressor plants. The accepted practice has been to use woven wire, chevron separators or cyclone separators downstream of the heat exchanger. An undesirable pressure drop is experienced in such separators, which can add significantly to the compressor plant operating costs, and the separators also add significantly to the overall capital cost and size of the intercooler system.

Intercooler heat exchangers often are very large; however, because the heat exchanger must function within the overall system which may include several stages of compression and several intercoolers, often relatively limited space is available for each heat exchanger. Thus, achieving the necessary heat transfer and moisture disentrainment within the space available can be difficult. The design of such a heat exchanger is further complicated by limitations in the suitable locations for the inlet and outlet nozzles of the heat exchanger which must connect with other system components, and by the velocity of flow of the process fluid. A designer of an intercooler is faced, therefore, with many fixed requirements, including the maximum shell size, the location and spacing of nozzles, the size of the piping to the nozzles and the maximum pressure drop allowable in the intercooler. These limitations make it difficult to achieve the objective of maximum temperature reduction at minimal pressure drop.

Frequently, design requirements are for inlet and outlet nozzles of the shell to be in close proximity. Maldistribution of the fluid then becomes a problem, with most of the fluid flowing along the area of the tube bundle or coil near the nozzles. Only a minimal flow occurs through portions of the heat exchanger on the side of the inlet opposite the outlet, with the portions farthest therefrom experiencing the least flow. This maldistribution problem makes proper sizing and heat exchange calculation very difficult. High shell side velocities can result in further maldistribution problems, contributing to higher pressure drops and decreasing the heat transfer performance of the heat exchanger. If shell side velocities can be reduced, maldistribution is lessened. In the past this has been difficult in that the vehocities to and from the heat exchanger are fixed by the requirements of the system. It would be beneficial, therefore, to reduce velocities within the shell.

Another problem encountered in the design of a compressor intercooler concerns servicing the intercooler and especially the tube bundles therein. Periodic cleaning and inspection of the tubes is desirable, and access to the tube bundles should not be difficult. In some instances, it is desirable to inspect and clean the tube bundles in a relatively short period of time, leaving the coils in place and without having to disconnect the water piping to the coils. In other instances it is desirable to remove the coils from the shell. In either case, easy access to both sides of the coil should be available for cleaning all fin surfaces. It is also desirable to be able to replace only a portion of the cooling coil, if necessary, and to be able to do so quickly. In previous designs for such heat exchangers, if part of the coil needs replacing, a substantial portion or all of the coil had to be replaced.

SUMMARY OF THE INVENTION

It is therefore one of the principal objects of the present invention to provide a heat exchanger which is suitable for use as an intercooler between compression stages in a compressor plant, and which can handle a large gas flow, performing the necessary heat exchange function with only a minimal pressure drop.

Another object of the present invention is to provide a heat exchanger of the aforementioned type which minimizes liquid carryover in the process fluid, and which obviates the need for demistors or separators downstream of the heat exchanger.

A further object of the present invention is to provide a heat exchanger having easy access to all sides of the heat transfer surfaces for maintenance and inspection, and which permits cleaning of the surfaces and tubes in place and without disconnecting the fluid supply to the tubes.

Yet another object of the present invention is to provide a heat exchanger of the fin and tube type having only minimal pressure drop therethrough and which permits removal of discrete portions of the tube bundles for cleaning, inespection or repair.

A still further object of the present invention is to provide an arrangement of components in an intercooler for a compressor which minimizes maldistribution of the fluid flowing therethrough, and which effectively uses the entire heat transfer surface provided therein, while reducing shell side velocities to minimize or eliminate liquid carryover.

These and other objects are achieved in the present invention by providing a heat exchanger having a shell with at least two coil banks disposed therein, the coil banks being optimally spaced to effectively use the entire heat transfer surface. The process fluid flowing into the shell it split, directed evenly through the coils, gathered and conducted out of the shell. The locations of components including the coils, necessary internal pipes and the flow directing structures are such that only minimal pressure drop through the coil is experienced. The velocity reduction and directional changes experienced by the process fluid from the aforementioned heat exchanger arrangement mimimizes carryover of condensed fluids. This eliminates the need for separate demistors or fluid separators downstream from the heat exchanger.

The shell includes at least one removable cover or end cap through which the coils can be extracted from the shell. Cleaning can be performed outside the shell, inside the shell with the cover removed, or inside the shell without the cover being removed, access being had through a manway. The coils are spaced in the shell such that cleaning all surfaces can be performed without removing the coils. Water box type headers with removable covers and inlet and outlet piping through the header sidewalls are used so that the tubes can be cleaned in place without disconnecting the supply and return lines to the header.

Further objects and advantages of the present invention will become apparent from the following detailed description and the accompanying drawing.

BRIEF DESCRIPTION OF THE DRAWING

FIG. 1 is a cross-sectional view of a heat exchanger embodying the present invention.

FIG. 2 is a cross-sectional view, partially broken away, of the heat exchanger shown in FIG. 1, taken on line 2—2 of the latter Figure.

FIG. 3 is a cross-sectional view, partially broken away, of the heat exchanger, the section being taken on line 3—3 of FIG. 1.

FIG. 4 is a cross-sectional view, partially broken away, of the heat exchanger shown in the preceding figures, the section being taken along line 4—4 of FIG. 1.

DETAILED DESCRIPTION OF THE PREFERRED EMBODIMENT

Referring now more specifically to the drawings, and to FIG. 1 in particular, numeral 10 designates a heat exchanger embodying the present invention. The heat exchanger shown in the drawings is most suitable for use as an intercooler between the compression stages of a large compressor, and the heat exchanger generally includes a cylindrical shell 12 having a process fluid inlet nozzle 14 and a process fluid outlet nozzle 16. The shell had heads or covers 18 and 20 enclosing the shell ends. Preferably, inlet nozzle 14 is located centrally at the top of the shell, and the outlet may be in the shell or one of the covers. In the preferred design, at least one of the heads is removably attached to the shell. In the drawings, head 18 includes a flange 22 which seats against a flange 24 disposed on shell 12. A plurality of bolts 26 hold the head to the shell in sealing engagement. Including a removable head on the intercooler shell enables easy access by maintenance personnel to the interior of the heat exchanger for servicing and/or repair. While both heads can be attached by flanges and bolts, in the drawings head 20 is shown to be welded to the shell. To permit quicker access to the shell interior for regular periodic servicing and/or inspection, a manway 28 having a removable cover 30 is provided in the shell wall. Through this manway, maintenance personnel can enter for periodic cleaning and/or inspection, and access thereto can be had more quickly and easily than by removing head 18.

Within the shell are two coil banks 40 and 42, each bank consisting of two coils. Hence, bank 40 includes a lower coil 44 and an upper coil 46, and bank 42 includes a lower coil 48 and an upper coil 50. Two coils in each bank are not essential. A bank could consist of only a single coil, or could consist of three or more coils. The number of coils used can be varied to best suit the requirements of the application for the heat exchanger. The description which follows is for the embodiment shown in the drawings, which includes two coils in each coil bank. Appropriate modifications for heat exchangers having banks of one, three or more coils will be apparent to one skilled in the art.

Coils 44, 46, 48, and 50 include a plurality of tubes 52 through which the water or other conditioning fluid flows. The tubes may pass through fins 54, or other extended surfaces for increasing heat transfer between the fluid in the tubes and the process fluid flowing about the tubes can be used. The tubes extend the length of the heat exchangers, and depending on the application for which a heat exchanger of the present invention is being used, the number of tubes and the number of passes which the fluid makes through the heat exchange coils will vary. In the drawing, each of the coils is a three-pass coil, and the tubes are placed in flow communication on their ends by water box-type headers. Inlet supply risers 56 and 58 are provided for inlet water box headers 60, 62, 64, and 66 on coils 44, 46, 48, and 50, respectively. A single outlet riser 68 is connected to the outlet water box headers 70, 72, 74 and 76 of coils 44, 46, 48, and 50, respectively. Partitions such as partitions 78 and 80 shown in the drawings are provided in each of the water box headers to separate the tubes in known fashion for causing the aforementioned three-pass flow through each coil. The coil banks are supported in the heat exchanger by "I" beams 82, 84, 86, and 88 which rest on an internal platform 90 held by channel supports 91, 92, and 94.

The water box headers include removable covers secured by bolts or the like 96. Removing the cover permits access to the tubes for cleaning and inspection. The inlet and outlet coolant connections to the headers are made in the sidewalls of the headers, and not in the covers. This permits access to the tubes by removing the covers without having to first disconnect the coolant line.

As mentioned previously, coil banks 40 and 42 are spaced from each other and from the shell, generally forming an inlet space 100 between the coil banks and two outlet spaces 102 and 104 between, respectively, bank 40 and shell 12, and bank 42 and shell 12. Preferably, inlet 14 is generally centrally disposed above inlet space 100. Blockoff baffles 106 and 108 at the ends of the coil banks, and side blockoff baffles 110 and 112 running the length of the banks vertically between the banks and the shell confine the incoming gas initially to the space above the coil banks, causing it to flow downwardly between the coils, for passing among the coil tubes 62 in heat exchange relationship as it flows outwardly to the outlet spaces. A perforated distributor plate 114 is disposed above the coil banks, restricting flow straight down from the inlet 14, causing the process gas to reach the extreme ends of the coil as well as the area directly beneath the inlet in a substantially even distribution. Other distributor devices such as screens, louvers, grills, cones and the like are known in the industry and can be used in place of the perforated plate.

From inlet space 100 the gas flows outwardly through the coil banks to outlet spaces 102 and 104. By splitting the process gas to flow through the two coil banks, the length of each bank can be shortened compared to previous designs in which one bank was used, and because of the corresponding shorter overall length of the shell, the inlet can generally be centrally located above the banks. The use of a distributor plate 114, which normally is in length about one and one-half times the inlet diameter, or the use of any other flow distributing device results in a substantially even distribution of fluid over the face of each coil, making effective use of the entire coil. The spacing of the coil banks from each other and from the shell is selected to mimimize flow maldistribution. Spacing which equalizes the velocity heads in the inlet and outlet spaces has been satisfactory.

Splitting the gas flow also reduces the velocity of the gas so that moisture which condenses on the fin surfaces can be conducted away from the surfaces and will not become entrained in the gas flow. A sump 120 is provided in the bottom of the shell for collecting the condensed fluid, and a drain 122 is provided for removing the condensate from the shell. In the intercooler embodiment shown the process fluid outlet nozzle is located at the top of the shell, toward the end of the shell, and the process gas flowing through the coil flows horizontally along the shell before turning to vertical flow for exiting the shell. The change in direction of the slower moving gas disentrains most of any liquid which may become entrained. Thus, the heat exchanger of the present invention substantially minimizes the carryover of liquid, additional demistors normally are not required, and the pressure drop experienced in demistors is eliminated.

The flow path of a process fluid through the heat exchanger is shown by arrows 130 in the drawings. The process fluid enters the heat exchanger through inlet nozzle 14 and flows generally downwardly into space 100 between coil banks 40 and 42. Perforated distributor plate 114 distributes the fluid flow such that the fluid reaches each end of the coil banks and is distributed substantially evenly across the faces thereof within space 100. Block-off baffles 106, 108, 110 and 112 limit fluid flow within the shell so that all of the process fluid flowing into the shell passes through the coil banks. As the process fluid flows through the coil banks, passing in heat exchange relationship with the coolant flowing through the tubes of the coils, moisture is condensed, and as a result of the decreased fluid velocity caused by splitting the fluid flow, the condensate can be conducted away along the fin surfaces to sump 120. From the sump the condensate flows out of the heat exchanger passing through drain 122. After having been cooled by passing through the coils, the process fluid flows in the spaces between the coil banks and the shell to the end of the heat exchanger nearest outlet 16. The cooled gas leaves the heat exchanger through outlet 16.

Periodic maintenance and inspection of the heat exchanger can be performed by entering the heat exchanger through manway 28. The inlet and outlet header covers can be removed without disconnecting the coolant supply and return lines, and the interior of the tubes can be cleaned and inspected. Since the coil banks are spaced from each other and from the shell wall, all sides of the coils can be accessed for cleaning and servicing. Access to the coil banks can also be had by removing cover 18, and if necessary, one or more of the coil banks can be removed from the shell through the opened end.

The present invention meets the objective in designing compressor plant intercoolers while recognizing the design limitations encountered. The split flow arrangement makes effective use of the entire heat exchanger surface by minimizing maldistribution. In addition, the split flow design reduces shell side velocities, minimizing carryover of liquids and eliminating the need for separate demistors. The split flow design also minimizes gas side pressure drop by splitting the flow between two or more coil banks and results in shorter shells than a conventional single coil bank arrangement.

Although one embodiment of a heat exchanger embodying the present invention has been shown and described in detail herein, various changes may be made without departing from the scope of the present invention.

We claim:

1. A compressor intercooler comprising a cylindrical shell having an inlet nozzle and an outlet nozzle therein; said inlet nozzle disposed in the upper middle portion of said shell to discharge downward into the central area of the interior of said shell; first and second vertical coil banks disposed longitudinally in said shell, said coil banks being spaced from each other and spaced from the shell so that said inlet nozzle discharges downward between said first and said second coil banks; and baffle means for constraining a fluid entering said inlet nozzle to flow through said coil banks, said baffle means disposed between each of said first and said second coil banks and said shell, said baffle means cooperating with said first and said second coil banks to further constrain the flow of a fluid entering said intercooler through said inlet nozzle to be split and to change direction a first time prior to passing through said coil banks and to change direction at least a second time, subsequent to passing through said coil banks, said splitting of fluid flow and said first fluid direction change causing said fluid to pass horizontally through said first and second coil banks in equal portions and at a velocity substantially reduced from the inlet velocity of said fluid to minimize the carryover of liquid condensed from the fluid as the fluid passes through said coil banks, said second direction change for promoting the disentrainment of condensed liquid carried out of said coil banks by said fluid as said fluid passes through said coil banks.

2. A compressor intercooler as defined in claim 1 in which a sump region is provided at the bottom of said shell for collecting condensate from said coil banks, and a drain from said sump is provided in said shell.

3. A compressor intercooler as defined in claim 1 in which distributing means for minimizing maldistribution of fluid is disposed below said inlet nozzle.

4. A compressor intercooler as defined in claim 3 in which said coil banks are positioned relative to each other and to said shell to provide substantially equal velocity heads in the inlet and outlet regions.

5. A compressor intercooler as defined in claim 1 in which each of said coil banks includes at least two coils.

6. A compressor intercooling comprising:

a cylindrical shell having an inlet through which a fluid to be conditioned enters said shell and an outlet through which said fluid exits said shell, said inlet disposed in the upper middle portion of said shell;

a first and a second coil bank, said first and said second coil banks including opposed heat exchange surfaces and being spaced apart from each other within said shell, said first and said second coil banks being mounted in said shell so that each of said first and said second coil banks is spaced apart from the wall of said shell and so that said inlet discharges directly between said opposed heat exchange surfaces of said first and said second coil banks;

riser means penetrating said shell and in flow communication with said first and said second coil banks, for supplying a conditioning fluid to and for returning said conditioning fluid from said first and said second coil banks;

baffle means disposed within said shell and attached to said first and said second coil banks and to the wall of said shell, for defining, in cooperation with said shell wall and said first and said second coil banks, an inlet space in flow communication with said shell inlet, a first outlet space between said first coil bank and said shell wall and a second outlet space between said second coil bank and said shell wall, said first and said second outlet spaces each being in flow communication with said shell outlet and said baffle means cooperating with said first and said second coil banks to constrain the flow of said fluid to be conditioned to be split and to pass through said first and said second coil banks at a reduced velocity; and means for distributing a fluid entering said shell inlet equally throughout said inlet space, whereby a fluid to be conditioned entering said shell inlet passes vertically downward into said inlet space, is equally distributed therein and is redirected a first time for horizontal flow prior to passing through said coil banks so that a first portion of said fluid passes evenly through said first coil bank and into said first outlet space and a second portion of said fluid passes evenly through said second coil bank and into said second outlet space, said first and said second fluid portions passing through said coil banks at a reduced velocity to minimize the carry-over of liquid condensed from said fluid portions as said portions pass through said first and said second coil banks respectively, said first and second fluid portions each being redirected at least a second time subsequent to passing through said coil banks to disentrain liquid therefrom and said fluid portions being gathered together within said shell prior to entering said shell outlet.

7. The compressor intercooler according to claim 6 wherein said distributing means comprises a perforated plate disposed in said shell between said shell inlet and the space between said spaced apart coil banks.

8. The compressor intercooler according to claim 6 wherein said first and said second coil banks each comprise finned tube heat exchangers each having removable inlet headers and removable outlet headers and wherein said means for supplying and returning conditioning fluid comprises riser means for supplying conditioning fluid and riser means for returning conditioning fluid, said riser means for supplying conditioning fluid and said riser means for returning conditioning fluid penetrating said shell, said inlet headers being in flow communication with said riser means for supplying conditioning fluid and said outlet headers being in flow communication with said riser means for returning conditioning fluid.

9. The compressor intercooler according to claim 8 wherein said shell defines a sump area, said intercooler further comprising a drain disposed in said sump area of said shell.

10. The compressor intercooler according to claim 8 wherein said shell includes a removable shell head.

11. The compressor intercooler according to claim 8 wherein said shell includes a manway access.

* * * * *